US009355808B2

(12) United States Patent
Huang et al.

(10) Patent No.: US 9,355,808 B2
(45) Date of Patent: May 31, 2016

(54) INJECTION LOCKED MAGNETRON MICROWAVE GENERATOR WITH RECYCLE OF SPURIOUS ENERGY

(71) Applicant: Sichuan University, Chengdu, Sichuan (CN)

(72) Inventors: Kama Huang, Sichuan (CN); Changjun Liu, Sichuan (CN); Yang Yang, Sichuan (CN); Xing Chen, Sichuan (CN); Huacheng Zhu, Sichuan (CN)

(73) Assignee: Sichuan University, Chengdu, Sichuan (CN)

( * ) Notice: Subject to any disclaimer, the term of this patent is extended or adjusted under 35 U.S.C. 154(b) by 0 days.

(21) Appl. No.: 14/729,300

(22) Filed: Jun. 3, 2015

(65) Prior Publication Data

US 2015/0270091 A1 Sep. 24, 2015

(30) Foreign Application Priority Data

Mar. 12, 2015 (CN) ..... 2015 1 0109032

(51) Int. Cl.
*H01J 25/50* (2006.01)

(52) U.S. Cl.
CPC ..... *H01J 25/50* (2013.01)

(58) Field of Classification Search
USPC ..... 315/39.51, 39.55, 502, 503, 504
See application file for complete search history.

(56) References Cited

U.S. PATENT DOCUMENTS

| | | | | |
|---|---|---|---|---|
| 6,949,887 | B2 * | 9/2005 | Kirkpatrick | H01J 61/025 315/246 |
| 9,041,291 | B2 * | 5/2015 | Neate | H01J 65/044 315/39 |
| 2010/0231144 | A1 * | 9/2010 | Leek | H05H 9/00 315/505 |

* cited by examiner

*Primary Examiner* — Thai Pham

(57) ABSTRACT

An injection locked magnetron microwave generator with a recycle of spurious energy, relating to a microwave power source, includes a frequency selective reflector for recycling the spurious energy of a magnetron and satisfies locking requirements of an output frequency of a high-output-power magnetron with a low-power injection signal. The microwave generator includes n magnetrons and n locking devices, n≥1. The locking devices inject locking signals into the corresponding magnetrons. The n locking devices are connected with a microwave source. Output terminals of the magnetrons are connected with corresponding frequency selective reflectors for reflecting the spurious microwave signals outputted by the magnetrons back to the magnetrons. The microwave generator, with a simple structure, effectively recycles the spurious energy outputted by the magnetrons, and reduces the power of the injection signal and costs of the microwave source and the overall microwave generator.

9 Claims, 3 Drawing Sheets

INJECTION LOCKED MAGNETRON MICROWAVE GENERATOR WITH RECYCLE OF SPURIOUS ENERGY

CROSS REFERENCE OF RELATED APPLICATION

The present invention claims priority under 35 U.S.C. 119 (a-d) to CN 201510109032. X, filed Mar. 12, 2015.

BACKGROUND OF THE PRESENT INVENTION

1. Field of Invention

The present invention, which belongs to a field of microwave source technology, relates to a microwave power source, and more particularly to an injection locked magnetron microwave generator.

2. Description of Related Arts

The microwaves are widely applied in the fields of radar, communication, microwave power transmission and microwave heating. Along with the development of economy and technology, the microwave energy is applied in more and more fields. The devices for generating microwaves are generally divided into the solid state devices and the vacuum tubes. The vacuum tubes generally have a high direct current to microwave conversion efficiency, and especially the magnetron, which belongs to the vacuum tube, has a low cost and a high power-mass ratio.

Despite of the high conversion efficiency, the magnetron usually has an extremely poor output characteristic that the output frequency and the output phase vary randomly, and thus becomes a microwave generator without a good output characteristic. The injection locking technology is able to improve the output characteristic of the magnetron, wherein a frequency of an output signal of the magnetron is controlled by a frequency of an external injection signal; and a fixed phase difference exists between a phase of the output signal and a phase of the external injection signal. A conventional injection locked magnetron system, as showed in FIG. 1, comprises a magnetron, a microwave source and a locking device. An accurate injection signal (a locking signal) with a stable frequency, generated by the microwave source, is injected into the magnetron through the locking device, for locking the magnetron. Due to the high parameter requirement upon the locking signal outputted by the microwave source, the microwave source usually has a complex structure. When an output power of the magnetron reaches 1 kW level, the injection locking requires an injection signal with high power, which leads to a high cost. Considering the cost, an injection signal with low power is injected into the magnetron to realize the injection locking, so as to reduce the cost of the microwave source and the cost of the overall microwave generator. The injection of the injection signal with the low power into the magnetron results in the multiple output frequencies of the magnetron, rather than a dot frequency. The magnetron has power outputting in a frequency band, wherein merely the microwave signal at a certain frequency is useful and the microwave signals at other frequencies are all useless, also called spurious microwave signals. It is failed to effectively lock the output signal of the magnetron and the spurious microwave signals are outputted, which reduces the useful power outputted by the magnetron and degrades the microwave conversion efficiency of the magnetron.

SUMMARY OF THE PRESENT INVENTION

Accordingly, in order to solve the above problems, the present invention provides a magnetron microwave generator having a frequency selective reflector for recycling spurious energy of a magnetron. The microwave generator stabilizes an output characteristic of the magnetron, satisfies a locking requirement of the magnetron with high output power by injecting an injection signal with low power, and increases a microwave conversion efficiency of the magnetron.

The technical solutions of the present invention are described as follows.

An injection locked magnetron microwave generator with a recycle of spurious energy comprises n magnetrons and n locking devices, wherein each locking device injects a locking signal into each corresponding magnetron; the n locking devices are connected with a microwave source; an output terminal of each magnetron is connected with a corresponding frequency selective reflector for reflecting a spurious microwave signal outputted by the magnetron back to the magnetron; and $n \geq 1$.

The magnetron is adopted as an emission source of the microwave generator and fully plays advantages of a high microwave conversion efficiency and high output power. Through the same microwave source as an injection signal source, microwave signals emitted by each magnetron are liable to be coherent microwave signals, forming a high-power coherent microwave source. The frequency selective reflector, with which the output terminal of each magnetron is connected, is able to reflect the spurious microwave signal emitted by the magnetron back to the magnetron for locking again, in such a manner that a low-power injection signal is able to lock a frequency of a high-output-power magnetron, which lays a foundation for a plurality of the magnetrons to share the same microwave source.

Preferably, the frequency selective reflector is a waveguide frequency selective reflector.

The waveguide frequency selective reflector has advantages of a simple structure, a low cost and high transmission power.

Further preferably, the waveguide frequency selective reflector is a rectangular waveguide frequency selective reflector.

The rectangular waveguide frequency selective reflector has a rectangular waveguide cavity for docking with the output terminal of the magnetron. The rectangular waveguide frequency selective reflector has advantages of a low cost and high transmission power.

Preferably, tuning screws are mounted on the waveguide frequency selective reflector. The tuning screws stretch into the waveguide cavity of the waveguide frequency selective reflector, for adjusting a reflecting frequency of the waveguide frequency selective reflector.

The tuning screws are mounted on the waveguide frequency selective reflector. The reflecting frequency of the waveguide frequency selective reflector is adjusted by adjusting a depth of the tuning screws into the waveguide cavity of the waveguide frequency selective reflector. The waveguide frequency selective reflector has a simple structure and is easy to be adjusted.

Preferably, the number of the tuning screws is three.

The waveguide frequency selective reflector with the three screws is a mature and simple-structured waveguide frequency selective reflector. By adjusting the depth of the three tuning screws into the waveguide cavity, the reflecting frequency of the waveguide frequency selective reflector is easily adjusted, so as to realize a frequency selective reflection.

Preferably, a distance between the frequency selective reflector and the magnetron is equal to a wavelength of the locking signal.

According to microwave transmission characteristics, when the distance between a mounting position of the frequency selective reflector and the magnetron is equal to the wavelength of the locking signal, influences on the magnetron after docking with the frequency selective reflector are effectively lowered.

Preferably, each locking device comprises a circulator and a load. The locking signal generated by the microwave source is injected into the magnetron through the circulator; and the microwave signal outputted by the magnetron is outputted through the circulator.

The circulator is a multi-terminal component, wherein a microwave transmits annularly in the circulator along a single direction; the circulator cooperates with the corresponding load, avoiding any mutual interference between an injection and an output of the microwave signal.

Preferably, the circulator is a waveguide four-terminal circulator. A first terminal of the four-terminal circulator is connected with the magnetron; a second terminal of the circulator is connected with the microwave source; a third terminal of the circulator is connected with the load; and a fourth terminal of the circulator is an output terminal.

The four-terminal circulator is preferred in the present invention. The four terminals exactly suit an application of the present invention. The first terminal of the four-terminal circulator is connected with the magnetron; the second terminal of the circulator is connected with the microwave source; the third terminal of the circulator is connected with the load; and the fourth terminal of the circulator is an output terminal of the microwave generator.

Furthermore, the microwave source is connected with the n locking devices through a power distributor. The power distributor is an n-channel power distributor. The locking signals of n channels, outputted by the n-channel power distributor, have the same frequency and a fixed phase difference.

The power distributor distributes the locking signals outputted by the microwave source. The power distributor is able to proportionally distribute the locking signals outputted by the microwave source to each locking device under requirements. The distributed locking signals are injected into the corresponding magnetrons for locking the frequency. Thus, the microwave generator is able to constitute a coherent power synthesis system with high output power.

Furthermore, the n magnetrons have the same structure and the n locking devices have the same structure.

According to the present invention, the n magnetrons have the same structure and the n locking devices have the same structure, which simplifies a structure of the generator, reduces a production cost, increases production efficiency and well suits an application of multi-magnetron coherent power synthesis.

The present invention has the following benefits. Through an injection locking theory and the frequency selective reflector, the microwaves outputted by the magnetrons are effectively locked and discreteness of the frequencies of the output signals of the magnetrons is decreased. The microwave generator of the present invention is easy to be manufactured, and is also able to effectively recycle the spurious energy of the output signals of the magnetrons, and lower the power of the injection signal and the cost of the microwave source, so as to reduce the cost of the overall microwave generator. The microwave generator of the present invention effectively increases the direct current to microwave conversion efficiency, and is especially suitable for the application of the multi-magnetron coherent power synthesis.

These and other objectives, features, and advantages of the present invention will become apparent from the following detailed description, the accompanying drawings, and the appended claims.

Figure 1:
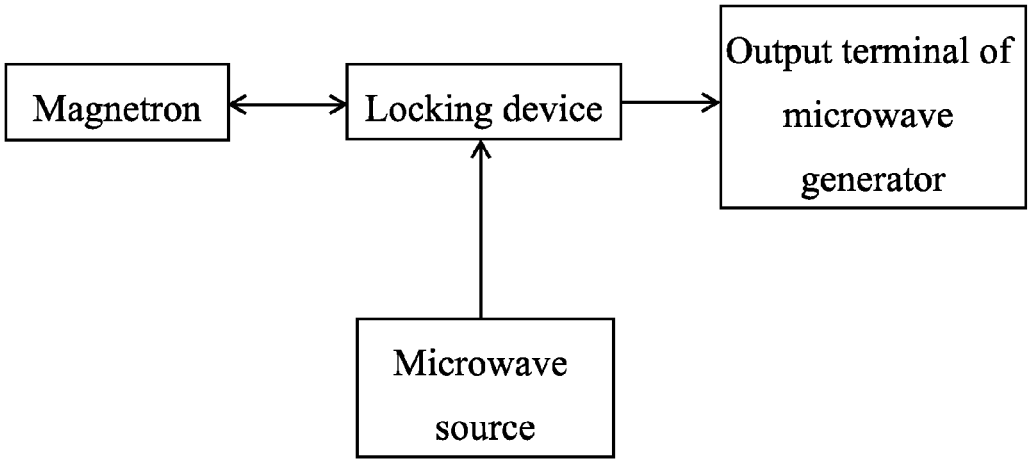
Fig. 1 (Prior art)
FIG. 1 is a sketch view of a conventional injection locked magnetron microwave generator.

In the figures, 1: magnetron; 2: waveguide four-terminal circulator; 3: load; 4: microwave source; 5: output terminal of microwave generator; 6: frequency selective reflector.

DETAILED DESCRIPTION OF THE PREFERRED EMBODIMENT

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

First Embodiment

Figure 2:
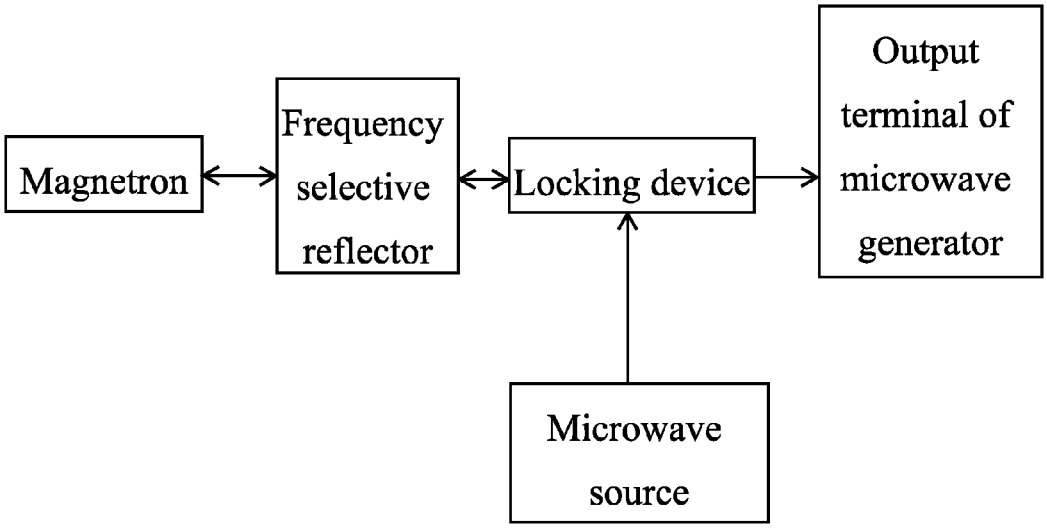
FIG. 2 is a block diagram of an injection locked magnetron microwave generator with a recycle of spurious energy according to a first preferred embodiment of the present invention.

Referring to FIG. 2 of the drawings, an injection locked magnetron microwave generator with a recycle of spurious energy comprises a magnetron, a corresponding locking device, a frequency selective reflector and a microwave source. The locking device, connected with the microwave source, injects a locking signal outputted by the microwave source into the magnetron, so as to lock a frequency of a microwave signal outputted by the magnetron at a frequency of an injection signal. A spurious frequency signal of the microwave signal, outputted by the magnetron, is reflected back to the magnetron by a frequency selective reflector which is connected with an output terminal of the magnetron. The spurious frequency signal, back to a resonance cavity of the magnetron, is locked again with the frequency of the injection signal. Then, the microwave signal, having the same frequency with the injection signal, is outputted. The frequency selective reflector is connected between the magnetron and the locking device as showed in FIG. 2.

Figure 3:
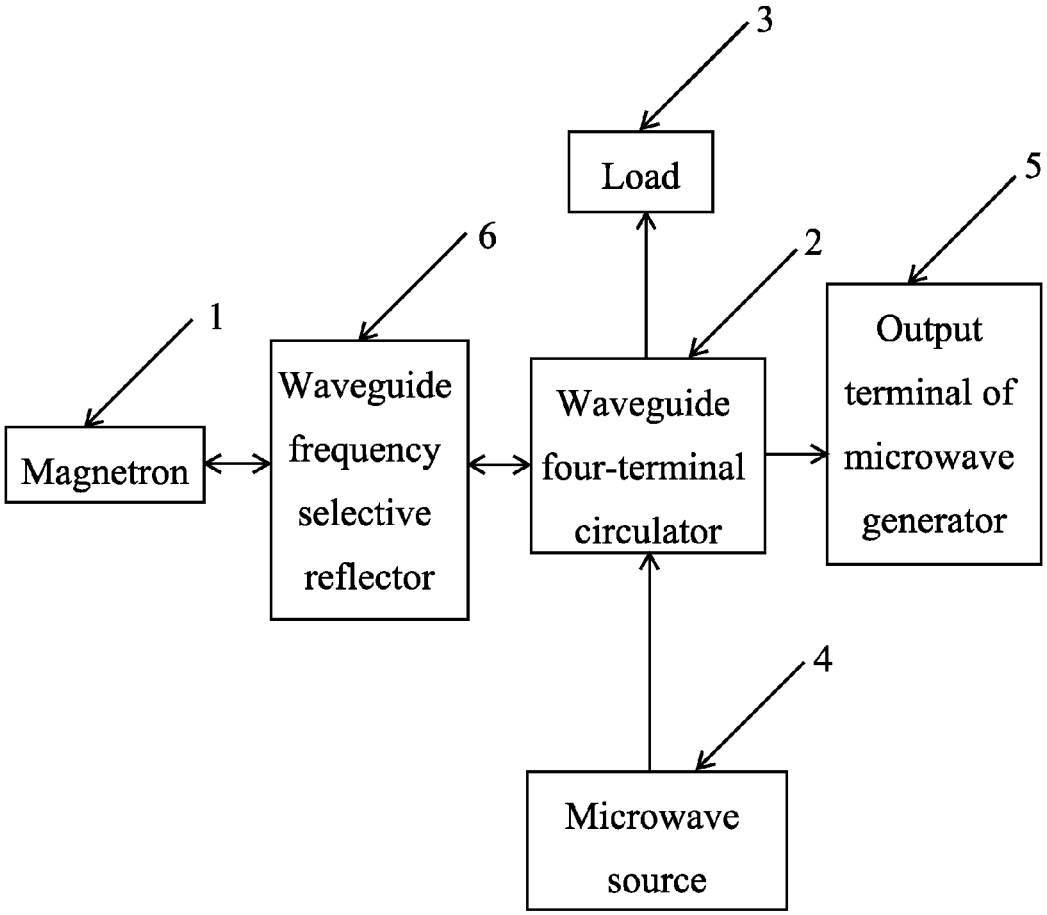
FIG. 3 is a sketch view of the injection locked magnetron microwave generator with the recycle of the spurious energy according to the first preferred embodiment of the present invention.

According to the first embodiment of the present invention, the locking device comprises a waveguide four-terminal circulator and a load. As showed in FIG. 3, the microwave generator comprises a continuous wave magnetron 1 of CK219, which is 15 kW at an S band, and a waveguide four-terminal circulator 2 of BJ22, a load 3, a microwave source 4, an output terminal 5 of the microwave generator and a waveguide frequency selective reflector 6. A first terminal of the waveguide four-terminal circulator 2 is connected with the magnetron 1; a second terminal of the waveguide four-terminal circulator 2 is connected with the microwave source 4; a third terminal of the waveguide four-terminal circulator 2 is connected with the load 3; and a fourth terminal of the waveguide four-terminal circulator 2 is connected with the output terminal 5 of the microwave generator. The locking signal, generated by the microwave source 4, is injected into the magnetron 1 through the waveguide four-terminal circulator 2. The microwave signal, outputted by the magnetron 1, is outputted through the waveguide four-terminal circulator 2. According to the first embodiment of the present invention, a microwave frequency of the microwave source 4 is 2.45 GHz. The injection signal, with power of 10 W, is injected into the magnetron 1 through the waveguide four-terminal circulator 2 and the waveguide frequency selective reflector 6. Because the power of the injection signal is merely 10 W, it is failed to completely lock the microwave frequency generated by the magnetron 1. Accordingly, the magnetron outputs a plurality of frequencies, wherein merely a power component at 2.45 GHz is useful and other frequencies components are all spurious signals. According to the first embodiment, the waveguide frequency selective reflector 6 is a rectangular waveguide frequency selective reflector having 3 tuning screws. A reflecting frequency is changed by adjusting a depth of the tuning screws into a rectangular waveguide cavity of the rectangular waveguide frequency selective reflector 6. A distance between the rectangular waveguide frequency selective reflector 6 and the magnetron 1 is equal to a wavelength of the injection signal, which is able to avoid an impact from the reflector upon a load reflection parameter of the magnetron. By adjusting the three tuning screws of the waveguide frequency selective reflector 6, the waveguide frequency selective reflector obtains a certain frequency selective characteristic. By adjusting the tuning screws and observing monitoring data of a spectrum analyzer, the output frequency of the magnetron is locked at 2.45 GHz, which recycles the spurious energy outputted by the magnetron and effectively improves a direct current to microwave conversion efficiency of the magnetron.

Second Embodiment

Figure 4:
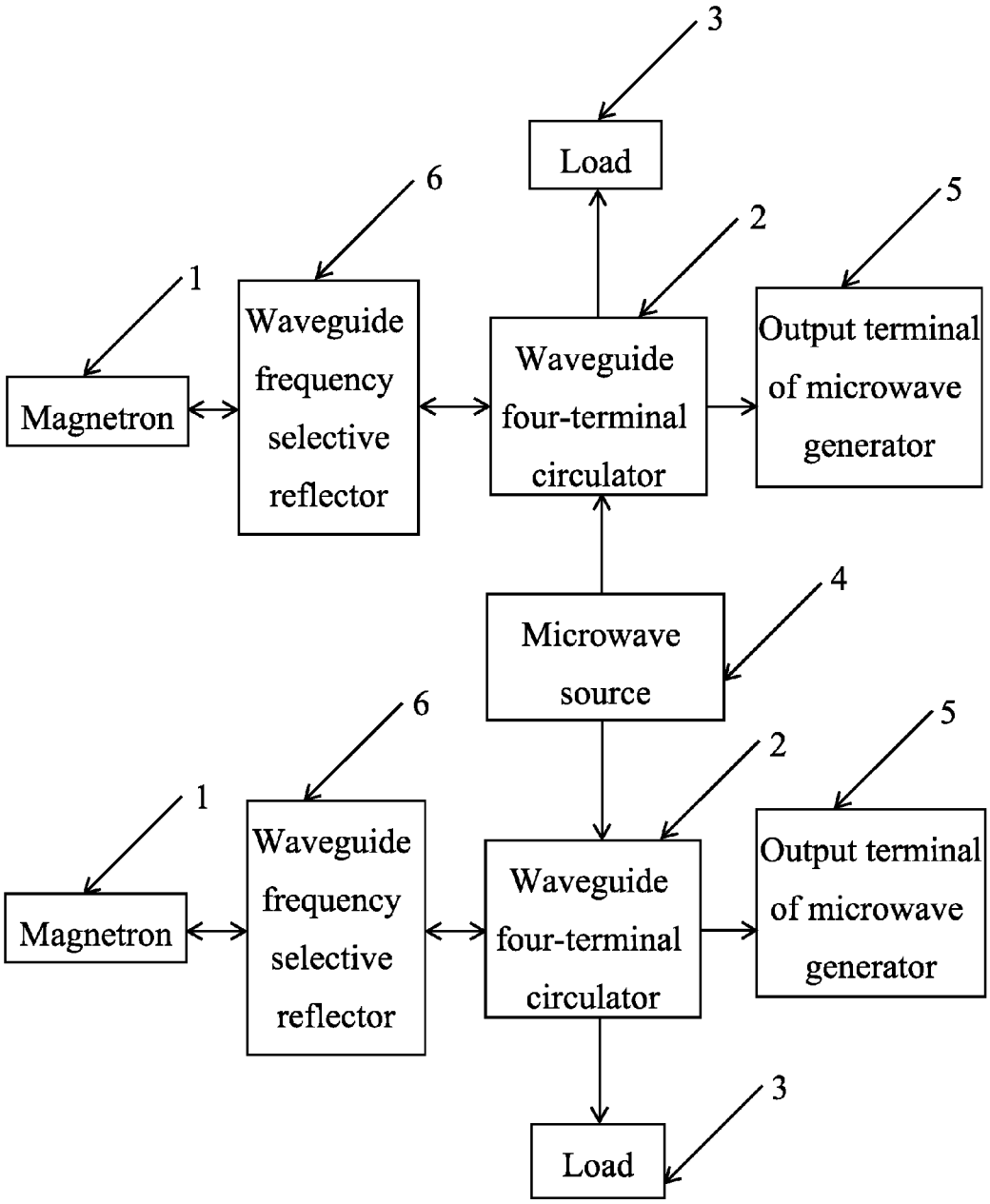
FIG. 4 is a sketch view of the injection locked magnetron microwave generator with the recycle of the spurious energy according to a second preferred embodiment of the present invention.

As showed in FIG. 4, according to a second preferred embodiment of the present invention, an injection locked magnetron microwave generator with a recycle of spurious energy comprises two magnetrons and two corresponding locking devices, wherein the two magnetrons have the same structure and the two locking devices have the same structure. The two locking devices are connected with the same microwave source 4 and obtain two channels of injection signals, having the same frequency and the same phase, from the microwave source 4 through a two-channel power distributor (unshown in FIG. 4), and then the injection signals are respectively injected into the two magnetrons. The microwave generator of the second embodiment is embodied as a combination of two systems of the first embodiment, wherein two output terminals 5 of the microwave generator are able to output coherent microwaves. By adding the magnetrons and the corresponding locking devices, a microwave generator with higher power is obtained. Because the locking devices of the microwave generator are connected with the same microwave source, it is easy to obtain coherent microwave injection signals of multiple channels for locking the frequencies of the magnetrons, and further a high-power microwave output. The power distributor distributes the same injection signal source, which greatly simplifies a structure of a coherent power synthesis system and broadens an application prospect.

What is claimed is:

1. An injection locked magnetron microwave generator with a recycle of spurious energy, comprising n magnetrons and n locking devices, wherein each said locking device is for injecting a locking signal into each corresponding magnetron, so as to lock a frequency of a microwave signal outputted by said magnetron at a frequency of said locking signal; said n locking devices are connected with a microwave source; an output terminal of each said magnetron is connected with a corresponding frequency selective reflector for reflecting a spurious microwave signal of said microwave signal, outputted by said magnetron, back to said magnetron; said spurious microwave signal, back to said magnetron, is locked again with said frequency of said locking signal, and then said microwave signal, having the same frequency with said locking signal, is outputted, so as to recycle said spurious energy outputted by said magnetron and improve a direct current to microwave conversion efficiency of said magnetron; said frequency selective reflector is connected between said magnetron and said locking device; and $n \geq 1$.

2. The injection locked magnetron microwave generator with the recycle of the spurious energy, as recited in claim 1, wherein said frequency selective reflector is a waveguide frequency selective reflector.

3. The injection locked magnetron microwave generator with the recycle of the spurious energy, as recited in claim 2, wherein said frequency selective reflector is a rectangular waveguide frequency selective reflector.

4. The injection locked magnetron microwave generator with the recycle of the spurious energy, as recited in claim 2, wherein a plurality of tuning screws are mounted on said waveguide frequency selective reflector; said tuning screws stretch into a waveguide cavity of said waveguide frequency selective reflector, for adjusting a reflecting frequency of said waveguide frequency selective reflector.

5. The injection locked magnetron microwave generator with the recycle of the spurious energy, as recited in claim 4, wherein the number of said tuning screws is three.

6. The injection locked magnetron microwave generator with the recycle of the spurious energy, as recited in claim 1, wherein a distance between said frequency selective reflector and said magnetron is equal to a wavelength of said locking signal, so as to lower influences of said frequency selective reflector on said magnetron.

7. The injection locked magnetron microwave generator with the recycle of the spurious energy, as recited in claim 1, wherein each locking device comprises a circulator and a load; said locking signal generated by said microwave source is injected into said magnetron through said circulator; and said microwave signal outputted by said magnetron is outputted through said circulator.

8. The injection locked magnetron microwave generator with the recycle of the spurious energy, as recited in claim 7, wherein said circulator is a waveguide four-terminal circulator; a first terminal of said circulator is connected with said magnetron; a second terminal of said circulator is connected with said microwave source; a third terminal of said circulator is connected with said load; and a fourth terminal of said circulator is an output terminal.

9. An injection locked magnetron microwave generator with a recycle of spurious energy, comprising n magnetrons and n locking devices, wherein:

each said locking device is for injecting a locking signal into each corresponding magnetron, so as to lock a frequency of a microwave signal outputted by said magnetron at a frequency of said locking signal; said n locking devices are connected with a microwave source; an output terminal of each said magnetron is connected with a corresponding frequency selective reflector for reflecting a spurious microwave signal of said microwave signal, outputted by said magnetron, back to said magnetron; said spurious microwave signal, back to said magnetron, is locked again with said frequency of said locking signal, and then said microwave signal, having the same frequency with said locking signal, is outputted, so as to recycle said spurious energy outputted by said magnetron and improve a direct current to microwave conversion efficiency of said magnetron; said frequency selective reflector is connected between said magnetron and said locking device; and $n \geq 1$;

said frequency selective reflector is a rectangular waveguide frequency selective reflector;

three tuning screws are mounted on said rectangular waveguide frequency selective reflector; and said tuning screws stretch into a waveguide cavity of said rectangular waveguide frequency selective reflector, for adjusting a reflecting frequency of said rectangular waveguide frequency selective reflector;

a distance between said rectangular waveguide frequency selective reflector and said magnetron is equal to a wavelength of said locking signal, so as to lower influences of said rectangular waveguide frequency selective reflector on said magnetron;

each locking device comprises a circulator and a load; said locking signal generated by said microwave source is injected into said magnetron through said circulator; and said microwave signal outputted by said magnetron is outputted through said circulator; and said circulator is a waveguide four-terminal circulator; a first terminal of said circulator is connected with said magnetron; a second terminal of said circulator is connected with said microwave source; a third terminal of said circulator is connected with said load; and a fourth terminal of said circulator is an output terminal.

* * * * *